United States Patent [19]

Wiger et al.

[11] Patent Number: 4,630,548

[45] Date of Patent: Dec. 23, 1986

[54] CENTER SILL HORIZONTAL DIVIDER

[75] Inventors: Henry K. Wiger, Arlington, Va.; Phillip G. Przybylinski, Schererville, Ind.

[73] Assignee: Pullman Standard Inc., Chicago, Ill.

[21] Appl. No.: 553,252

[22] Filed: Nov. 18, 1983

[51] Int. Cl.[4] ..... B61D 17/00

[52] U.S. Cl. ..... 105/416; 105/418; 280/787; 52/729

[58] Field of Search ..... 105/413, 414, 418, 416, 105/417, 419; 280/786, 787; 52/729, 730, 731

[56] References Cited

U.S. PATENT DOCUMENTS

| | | | |
|---|---|---|---|
| 965,185 | 7/1910 | Hickman | 52/730 X |
| 1,078,310 | 11/1913 | Rohlfing | 105/414 |
| 2,127,683 | 8/1938 | Fenstermacher et al. | 105/415 |
| 2,788,750 | 4/1957 | Priest | 105/416 X |
| 3,145,666 | 8/1964 | Spence et al. | 105/416 |

*Primary Examiner*—Robert B. Reeves

*Assistant Examiner*—Glenn B. Foster

*Attorney, Agent, or Firm*—Richard J. Myers & Assoc.

[57] ABSTRACT

A railway car underframe includes a center sill having a central section and opposite end sections. The sill includes spaced vertical walls, and upper and lower walls which are slotted in registry the length of the central section, and which form in cross section a spaced I-beam construction. The construction provides a sill having high torsional flexibility which is necessary to accommodate the railway car to track conditions tending to derail the car when single axle suspensions with two wheels are utilized. The sill also includes a separator in the form of a channel which includes flanges at its sides which are secured to the vertical walls of the sill. The separator extends substantially the length of the slots and is effective to resist lateral forces tending to buckle during operation while not adversely affecting the high torsional flexibility which is required in the sill structure.

14 Claims, 10 Drawing Figures

CENTER SILL HORIZONTAL DIVIDER

BACKGROUND OF THE INVENTION

This patent application is related to U.S. patent application Ser. No. 553,316 entitled Cross Bearer Arrangement for Slotted Center Sill by applicants John H. Spence and Phillip G. Przybylinski and a patent application filed on the same date as this application and entitled Double Groove Center Sill by applicants Henry K. Wiger and Manfred Katz.

1. Field of Invention

This improvement relates to the field of flat railway cars having a torsionally flexible center sill to accommodate conditions occurring with the use of single axle wheel trucks which, due to track irregularities, could cause operating problems.

2. Description of the Prior Art

In the present improvement the center sill and associated structure is made torsionally flexible by the use of a slotted sill and other associated structures which accommodate operating conditions occurring as a result of track conditions. Slotted center sills are old in the prior art as indicated in Fenstermacher et al. U.S. Pat. No. 2,217,683 which includes a rigid structure having no torsional flexibility, the utilization of the slot merely being for the purpose of taking weight out of the structure. The Miller et al. U.S. Pat. No. 3,777,671 also discloses a rigid underframe having a sliding sill with a transverse divider plate. Neither of these patents relate to the present improved design.

SUMMARY OF THE INVENTION

The present invention relates to a flat car center sill with an improved cross bearer construction, the sill having upper and lower aligned slots. The flat car is utilized with a center sill having a torsionally flexible capability which will accomodate the car utilizing single axle suspensions, rather than the conventional four wheel car truck.

The present improvement relates primarily to the use of a flanged separator channel which is positioned within the center sill and is substantially coextensive with the slots. The separator channel is connected to the vertical side walls of the center sill section. This separator has a primary function in permitting the two I-beams of the slotted sill to act as a unit beam and absorb lateral forces without restricting the torsional ability of the center sill.

DESCRIPTION OF THE PREFERRED EMBODIMENT

Figures 1, 2, 3:
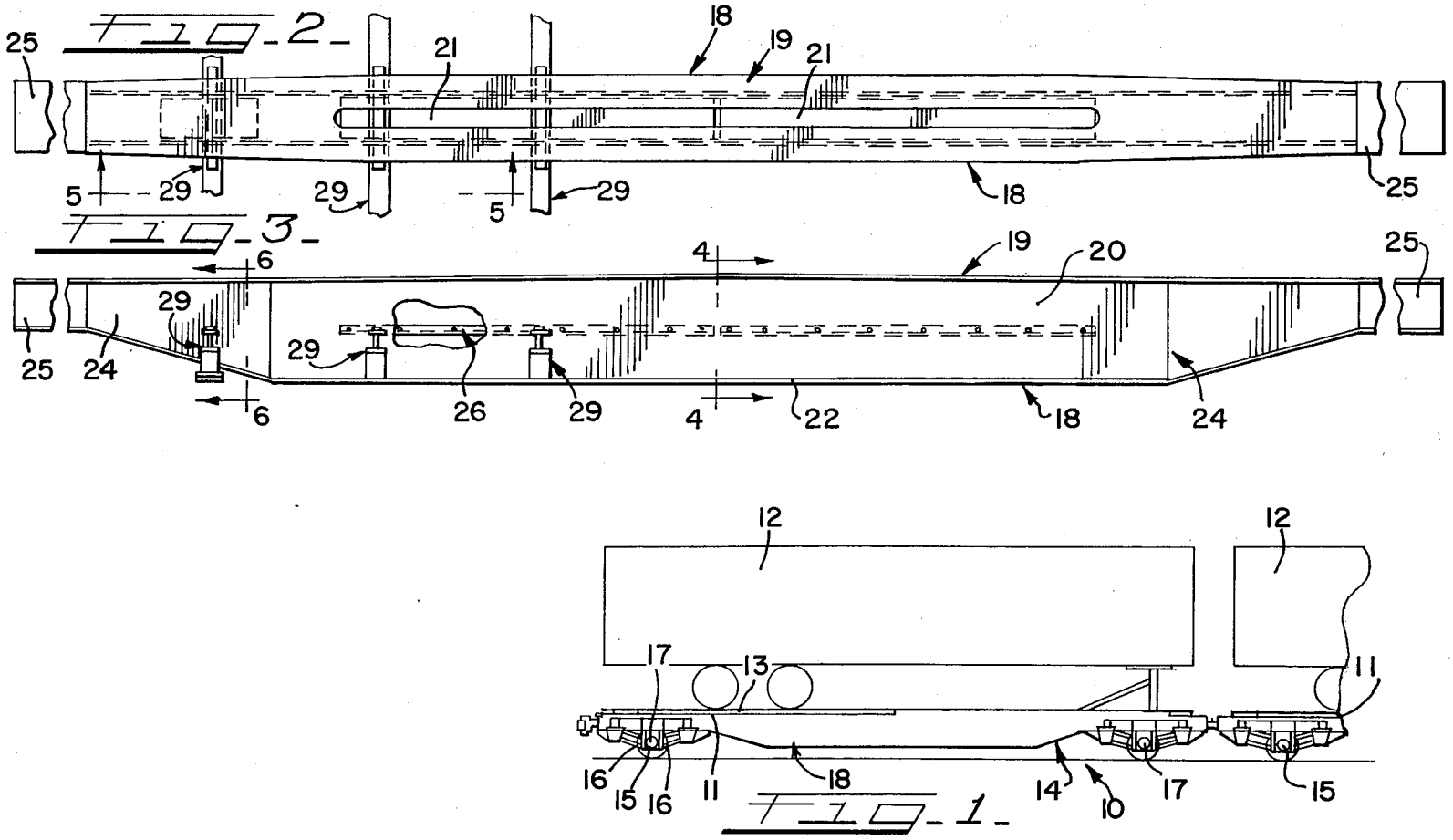
FIG. 1 is a side elevational view of a two flat car train having single axle trucks.
FIG. 2 is a plan view of an improved center sill, disclosing cross bearers connected to the sill.
FIG. 3 is a side elevational view of the sill and deck structures of FIG. 2.

Referring to the drawings, and particularly FIG. 1, a railway car train 10 comprises two flat cars 11 which may each carry a load such as a highway cargo trailer 12. The cars 11 each include cargo support ramps or deck members 13 and an underframe 14. The underframe 14 is supported on its ends on a single axle wheel truck 15 having suitable spring suspension 16 and a single axle 17.

Figure 4:
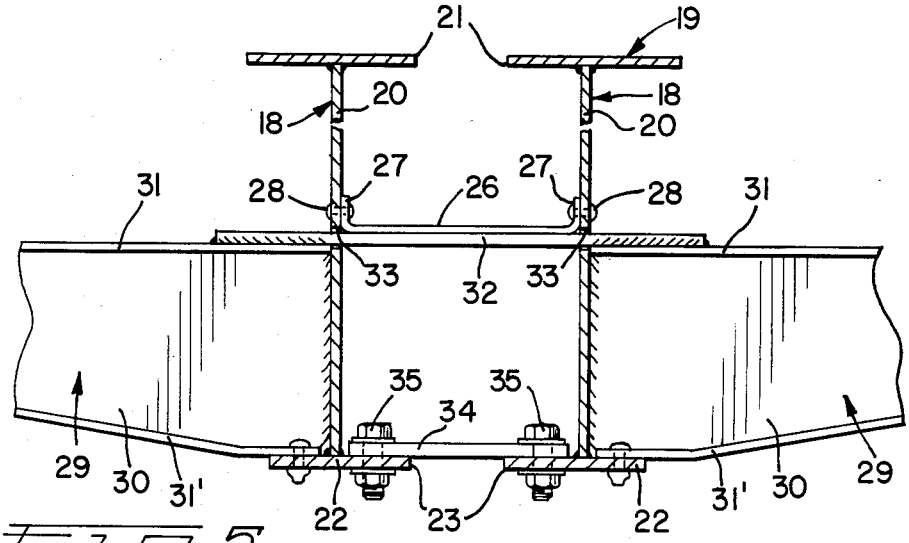
FIG. 4 is a cross sectional view taken substantially along line 4—4 of FIG. 3.
Figure 5:
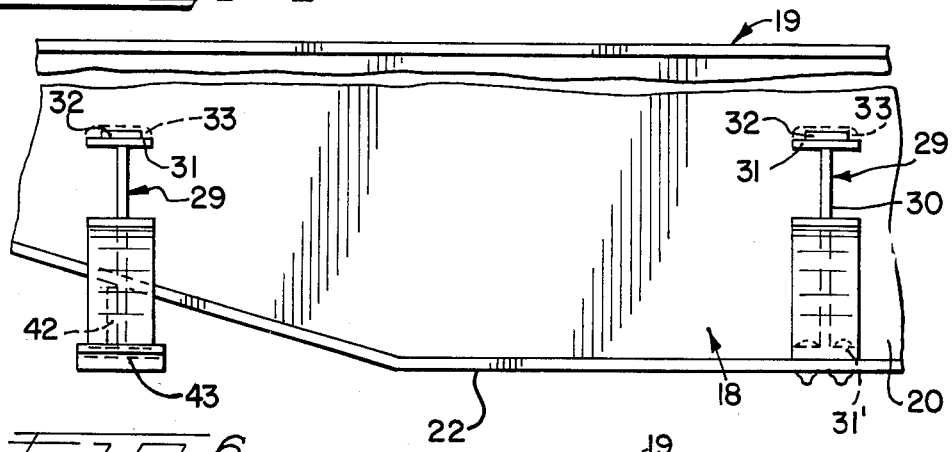
FIG. 5 is a side sectional view of a center sill and cross bearer structure, generally along the line 5—5 of FIG. 2.
Figure 6:
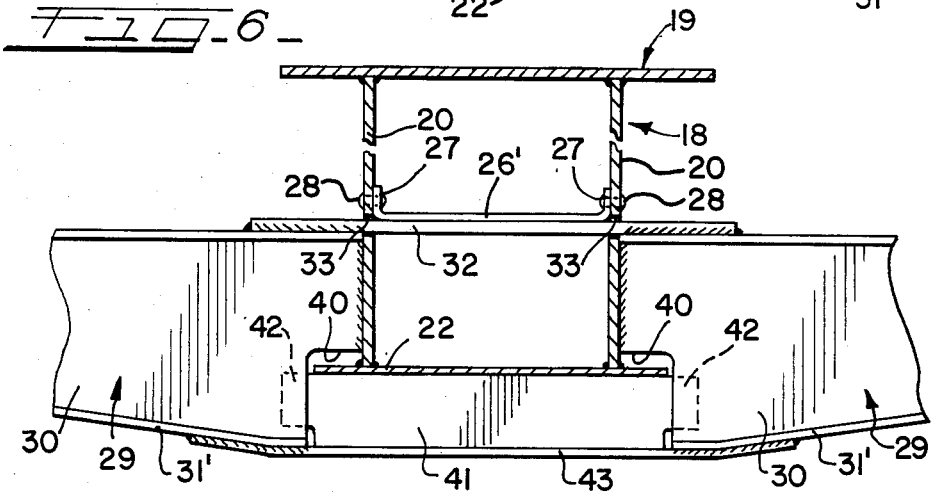
FIG. 6 is a cross sectional view of a modified cross bearer structure taken along the line 6—6 of FIG. 3.
Figure 7:
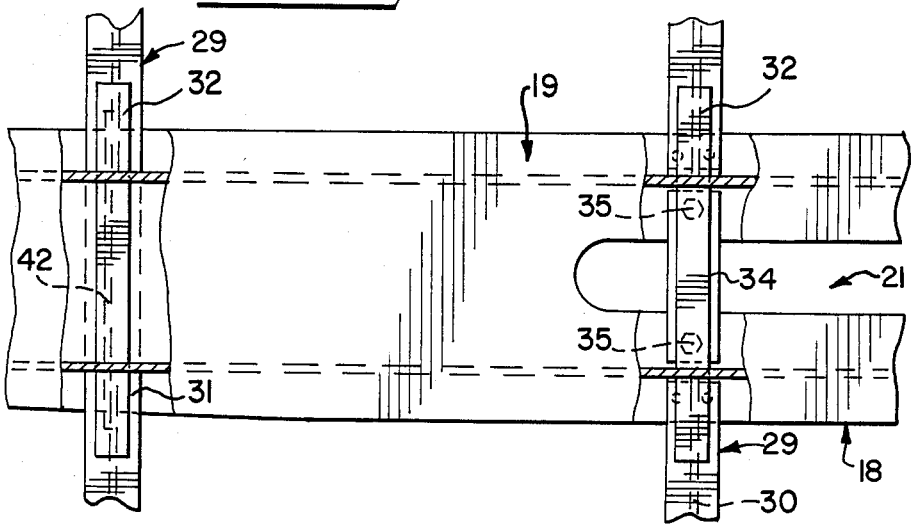
FIG. 7 is a plan view of several cross bearers in which one of the cross bearers is located in one end section of the sill having a tapering reduced height section.

The underframe 14 includes a rigid central or center sill 18 comprising a top horizontal plate 19 connected to vertical plates 20. The top horizontal plate 19 includes a horizontal slot 21 and a lower horizontal plate 22 includes a similar slot 23, the two slots being substantially in registry. As best shown in FIGS. 4 and 6, the section of sill which is slotted appears to represent two parallel I-beams.

As best shown in FIG. 3, the sill 18 has a constant vertical height but is provided at opposite ends with transition sections 24 having the lower horizontal plate 22 tapering upwardly and being connected to end sill stubs 25 while still substantially maintaining the shape in cross section of the total sill structure. As best shown in FIG. 2, the slots are contained mainly in the central section of the sill. As best shown in FIG. 2 the transition sections 24 also slope slightly inwardly to the end sill stubs 25. As best shown in FIGS. 2 and 4, a separator channel 26 includes connecting means in the form of flanges 27 which are secured by suitable fasteners 28 to the side walls 20 of the sill and extend substantially the length of the slots 21 and 23.

A cross bearer structure 29 for the improved sill is disclosed in FIG. 4. A plurality of these structures are utilized in spaced relation along longitudinally spaced portions of the center sill to support deck members 13. The cross bearers 29 comprises vertical webs or walls 30 which maybe suitably welded to the sill side walls 20. Each cross bearer structure 29 includes top flanges 31 and bottom flanges 31' welded to the webs 30. The cross bearers extend laterally outwardly from opposite sides of the center sill and support in conventional fashion cargo ramps or deck members 13, as shown in FIG. 1, on each side of the car. The upper plates or flanges 31 are interconnected by a tie plate 32 which extends through aligned openings 33 provided in the vertical sill walls 20. The tie plate 32 is connected to the separator channel 26 and may be welded to the separator channel. The inner ends of the lower plates 31' are riveted to the horizontal sill plate 22. The inner portions of the horizontal sill plate 22 in the region of the cross bearer structures 29 are connected by means of a tie-bar 34 and bolt and nut connections 35.

FIG. 6, taken along line 6—6 of FIG. 3, discloses the construction of the cross bearer in the transition section of the end portions of the center sill structure. As shown, the lower horizontal plate 22 of the center sill tapers upwardly toward the end of the car. The cross bearer structure includes the same essential parts, namely the webs 30 connected to the vertical plates 20 of the sill. The upper flanges 31 also are connected by means of a tie-plate 32 extending through the openings 33 of the center sill and are attached to a short piece of separator channel 26'. In the cross bearer construction in the region of the transition sections the webs 30 are slotted as indicated at 40 to accommodate the angular or inclining tapering portions of lower horizontal plate 22 in the transition sections. As shown in FIG. 6, a transverse tie plate 41 welded to the bottom plate 22 has end wing portions 42 welded to the webs 30 to provide a strong structure. A bottom reinforcing tie plate 43 is rigidly connected to the ends of the lower flanges 31' and tie plate 41.

THE OPERATIONAL FEATURES AND FUNCTION

The present improvement is involved in the invention of an improved underframe which has high non-uniform torsional flexibility and resistance to flexure-torsion buckling. The feature is highly important in railway flat cars wherein the cars are supported on single axle suspensions rather than the four wheel railway car truck.

Due to the uneven profile of American railroad track and the 39 ft. staggered rail used, freight cars (and suspensions) are required to follow rail profiles which raise (or lower) diagonally opposite corners of the car. If the suspension lacks sufficient compliance and the car body has a high torsional stiffness, it is possible for a wheel in the low (valley) portion of the track profile to lift off the rail (car then being supported at its other three corners). If this condition occurs when the car or wheelset is subjected to lateral forces, a derailment is possible.

The standard freight car is isolated from much of this torsional input by the standard "3-piece" truck which uses a centerplate-bowl support system that allows the carbody to rock (or tip) relative to the wheelsets in addition to the flexibility of the springs which accommodate further rail unevenness. However, in the case of the present flat car design, which uses single axle suspensions on each end of the car, the centerplate-bowl support system is eliminated. Therefore, track profile must be accommodated by the suspension springs and also the carbody as a torsional spring. When this torsional spring is stiff, less overall compliance (carbody plus suspension springs) is available to follow track irregularities (smaller track profile deviation can be tolerated). As a reference, the American Association of Railroads now requires one corner (wheel) of the empty car to be raised 5" without lifting any other wheel. The present flat car design thus requires a torsionally flexible center sill (backbone of the carbody) to aid the suspension in meeting this A.A.R. requirement.

A non-uniform torsionally flexible center sill design is obtained in the present improvement by using a basic box type center sill with a top and bottom slot in the central portion of the car. In this slotted area, the cross-section resembles a double I-beam section joined by a horizontal separator plate 26. Design of the center sill is complicated by other load conditions that must be satisfied while retaining non-uniform torsional flexibility. These load cases are basically compressive loads, and vertical and lateral bending loads. Also, the overall geometry of the car requires a shallow section center sill 24-25 at the end of the car to accommodate the wheelset, suspension, and bolsters while a deeper stronger section is allowed in the central area. It is necessary to slot the stronger, deep section in order to utilize the effect of the end restraint against warping on the magnitude of the angle of twist. The shallow end section must be torsionally rigid to develop non-uniform warping shear and normal stresses in the deep section.

Highway cargo trailers of the fifth wheel hitch type are ideal cargo for railway cars having the invention herein disclosed as they essentially impose a three point loading on the car body structure with the kingpin locked to, but enabled angular movement with respect to, the hitch. Therefore, the relatively rigid structure of the trailer body is not transferred to the railway car in a manner which resists torsional flexing of the center sill.

Figure 8:
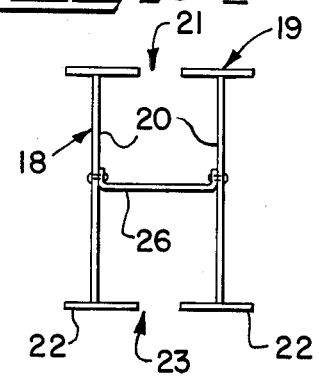
FIG. 8 is a schematic view showing a sill and separator structure in an untwisted position.
Figure 9:
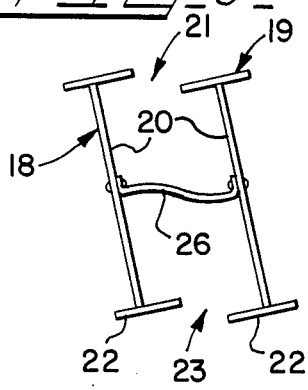
FIG. 9 is a similar view showing the torsional sill in a twisted position.
Figure 10:
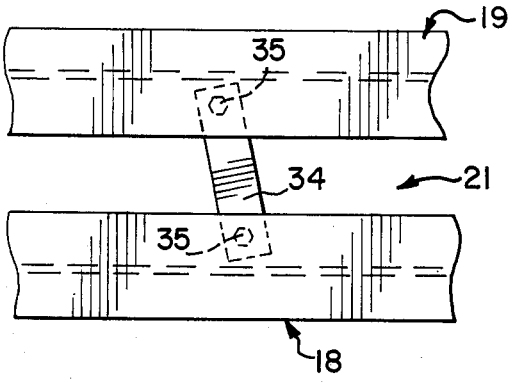
FIG. 10 is a schematic view of the two part cross bearer construction and the loading distribution thereon.

In design of an open center sill construction, the problem of buckling under compressive loads (A.A.R. requires 1,000,000 lbs.) is significant. In order to stabilize the slotted deep center sill section (in the shape of two parallel I-beams) the horizontal separator channel or plate 26 is attached between the I-beams near mid-height of the web. Individually each I-beam on figuration has sufficient strength to resist buckling in the vertical direction, but not in the lateral direction (the weak direction of the I-beam). The addition of the horizontal separator forces the two I-beams to act as a unit beam laterally with sufficient buckling strength. However, this separator design does not significantly reduce the torsional flexibility of the individual I-beams. Other means of typically bracing two beams (vertical separators or flange crossbracing) would restrict the warping deflections of the I-beam when twisted. Attaching the separator 26 near mid-height of the I-beam web, uses the portion of the I-beam with minimum motion or distortion due to torsion. The separator 26 is configured as a pressed channel and bolted to the I-beam webs. Some rotational deflection does occur in the web area of the I-beam which is resisted by the relatively low bending stiffness of a flat plate. An exaggerated sketch of this deflection is disclosed specifically in FIGS. 8 and 9.

In addition to the rotation of the I-beam when twisted, the flanges on each side of the slot warp longitudinally relative to each other with maximum warping occurring at midspan and diminishing to zero at the ends. This translation or warping creates difficulties in attaching any lateral beams across both sides of the center sill (I-beams) since any member rigidly attached to both I-beams will restrict the motion of the beams (centered about 12" apart) reducing torsional flexibility and also incurring large loads in the attachment itself. Since the torsional loading from the rail is a repeated occurrence, such points will typically fail due to fatigue. Since the car design required crossbearers 29 (for deck supports) to span both I-beams in the deep center sill section, it is necessary to provide the design disclosed in in FIGS. 4, 5, 6, and 7 in which, effectively, each crossbearer consists of two parts, each cantilevered off one side of a center sill I-beam.

Each I-beam can easily support the vertical load but not the moment resisting forces. Moment resistance is obtained from top and bottom crossbearer flange forces. For loads due to car rocking, the top flange force is reacted through the tie bar 32, into the horizontal separator channel which acts as a beam web for lateral loads. Since this attachment occurs near mid-height of the I-beams torsional deflections and effects are minimized. The bottom flange force is reacted into the bottom flange of each I-beam and shared between both I-beams by the bolted tie link 34 which has rotation freedom (about the vertical axis to allow the I-beam flange longitudinal translation (by rotating link).

For vertical loads only, the moment resisting forces of a crossbearer on one side are transferred through the centersill and react against the forces of the crossbearer on the other side by means of the top (tension) and the bottom (compresssion) tie bars.

Thus it is believed that a new and improved railway car underframe having torsional characteristics which provide for the safe and effective utilization of single axle suspension has been described and disclosed.

What is claimed is:

1. For a railway car having an underframe adapted to be supported on single axle suspensions at opposite ends of said car;

said underframe including an elongated center sill comprising upright laterally spaced, side walls upper and lower horizontal walls connected to said side walls and being substantially coextensive therewith, the improvement comprising:

a longitudinal center section of said upper and lower horizontal walls having torsional flexure means providing for movement of said side walls with respect to each other and to provide in said sill torsional flexibility for twisting movement of the longitudinal ends of the center sill to accommodate variations in track profile tending to raise and lower opposite corners of the underframe and car body carried thereon, said flexure means having therein elongated slots in vertical registry in the upper and lower horizontal walls, and reinforcing means connecting said side walls to each other intermediate said upper and lower horizontal walls to resist buckling forces in a lateral direction of said side walls.

2. The improvement in accordance with claim 1, said reinforcing means connecting said side walls including a horizontally extending separator channel connected to said side walls.

3. The improvement in accordance with claim 2, said separator channel extending substantially coextensive with said elongated openings.

4. The improvement in accordance with claim 3, said vertical and horizontal walls of said sill in cross section providing a double I-beam configuration having torsional flexibility, and said channel including connecting means connected to said side walls to provide stability in said I-beam configuration against forces in a lateral direction.

5. The improvement in accordance with claim 1, said reinforcing means connecting said side walls comprising a U-shaped structural separator extending substantially the length of said horizontal openings.

6. The improvement in accordance with claim 5, said structural separator including longitudinal flanges connected to said side walls of said sill.

7. The improvement in accordance with claim 6, said center sill including a longitudinal middle section of constant vertical dimension, and opposite end sections of non-constant vertically tapering configuration, said separator extending substantially the length of said middle section.

8. The improvement in accordance with claim 7, said separator being positioned between said side walls substantially midway between said horizontal walls.

9. The improvement in accordance with claim 8, said separator having vertical flanges connected to said side walls.

10. The improvement in accordance with claim 9, said separator resisting lateral forces tending to buckle said side walls while permitting torsional flexibility of said sill.

11. A railroad car comprising:

a pair of single axle railway trucks; and an underframe adapted to be supported on said car trucks, said underframe including a longitudinally extending center sill;

said center sill having longitudinally opposite end portions being operatively associated with said car trucks and an intermediate portion connecting said end portions;

said intermediate portion having torsionally flexible means providing torsional flexure of the center sill to permit relative angular twisting of said end portions along a longitudinal axis to accommodate track profiles which tend to raise opposite corners of the underframe; and said flexible means including a pair of laterally spaced upright wall means connected to the end portions and being allowed movement to provide for torsional flexibility of the flexible means; and reinforcing means for resisting lateral buckling of the wall means, said reinforcement means being connected to both of the wall means to support laterally direction forces therein; and said reinforcing means being connected to said wall means at approximately midheight of the wall means thereby receiving the minimum stress due to relative movement of the wall means during torsional flexure.

12. The invention according to claim 11, and each of said end portions comprising:

a pair of laterally spaced upright side walls formed integral with the wall means of the flexible means, and generally horizontal top and bottom walls connected to the side walls.

13. A railway car comprising:

a pair of single axle railway car trucks; and an underframe adapted to be supported on said car trucks, said underframe including a longitudinally extending center sill;

said center sill having longitudinally opposite end portions being operatively associated with said car trucks and an intermediate portion connecting said end portions;

said intermediate portion having torsionally flexible means providing for torsional flexure of the center sill to permit relative angular twisting of said end portions along a longitudinal axis to accommodate track profiles which tend to raise opposite corners of the underframe; and said flexible means including a pair of laterally spaced upright wall means connected with the end portions and being allowed movement to provide for torsional flexibility of the flexible means; and reinforcement means for resisting lateral buckling of the wall means, said reinforcement means being connected to both of the wall means to support laterally directed forces therein;

each of said end portions comprising:

a pair of laterally spaced upright side walls formed integral with the wall means of the flexible means, and generally horizontal top and bottom walls connected to the side walls;

said flexible means including a pair of longitudinally extending top portions connected to the wall means, said top portions being attached to both of the end portion top walls, the top portions defining therebetween a top sill opening for permitting the upper ends of the wall means to move relative to each other in torsional flexure of the center sill, a pair of longitudinally extending bottom portions connected to the wall means, said bottom portions being attached to both of the end portion bottom walls, and the bottom portions defining therebetween a bottom sill opening for permitting the lower ends of the wall means to move relative to each other in torsional flexure of the center sill.

14. The invention according to claim 13, and said reinforcement means comprising a generally horizontally extending separator member attached to the wall means at approximately mid-height thereof whereby the separator member experiences minimum stress during torsional flexure of the center sill.

* * * * *